US006727426B2

(12) United States Patent
Vans Evers

(10) Patent No.: US 6,727,426 B2
(45) Date of Patent: Apr. 27, 2004

(54) AUDIO CABLES WITH MUSICALLY RELEVANT MECHANICAL RESONANCES AND PROCESS FOR MAKING SAME

(76) Inventor: Claude Michael Vans Evers, 5815 6th St., Tampa, FL (US) 33611

( * ) Notice: Subject to any disclaimer, the term of this patent is extended or adjusted under 35 U.S.C. 154(b) by 0 days.

(21) Appl. No.: 10/192,003

(22) Filed: Jul. 8, 2002

(65) Prior Publication Data

US 2004/0003937 A1 Jan. 8, 2004

(51) Int. Cl.[7] ..... H01B 7/00
(52) U.S. Cl. ..... 174/27; 174/113 R
(58) Field of Search ..... 174/28, 29, 26 R, 174/110 R, 111, 113 R, 102 R, 103, 105 B, 108

(56) References Cited

U.S. PATENT DOCUMENTS 4,404,424 A * 9/1983 King et al. ..... 174/34
4,413,469 A * 11/1983 Paquin ..... 57/293
4,538,023 A 8/1985 Brisson
4,628,151 A 12/1986 Cardas
4,767,890 A 8/1988 Magnan
4,939,315 A * 7/1990 Palmer ..... 174/36
4,945,189 A * 7/1990 Palmer ..... 174/32
5,015,800 A * 5/1991 Vaupotic et al. ..... 174/34
5,064,966 A * 11/1991 Palmer ..... 174/32
5,142,105 A * 8/1992 Kihlken et al. ..... 174/112
5,401,908 A * 3/1995 Rodeghero ..... 174/112
5,606,151 A * 2/1997 Siekierka et al. ..... 174/113 R
5,929,374 A * 7/1999 Garland ..... 174/28
6,273,977 B1 * 8/2001 Harden et al. ..... 156/51
6,573,813 B1 * 6/2003 Joannopoulos et al. ..... 333/342
6,635,826 B2 * 10/2003 Yamamoto et al. ..... 174/117 F

* cited by examiner

*Primary Examiner*—William H. Maye, III
(74) *Attorney, Agent, or Firm*—David A. Guerra

(57) ABSTRACT

The audio cable is having a multi-conductor cable, two or more conductor assemblies, at least one partition for creating additional mechanical resonances, and appropriate connectors, coverings, insulation and labels each of which features selected mechanical resonances. The partitions can be a hinge partition produced from selectively twisting the conductor assemblies, or a mass partition produced by fastening either a wire binding wound over the conductor assembly or a conductor of different mass from that of the conductor assembly and thereto. The audio cable resonances are adjusted by dividing the conductor assembly into multiple partitions. The length, mass, color and compliance of each partition are adjustable to produce resulting mechanical resonances, thereby determining the sound of the audio cable when used with microphonic or vibrationally-sensitive electronics.

18 Claims, 2 Drawing Sheets

AUDIO CABLES WITH MUSICALLY RELEVANT MECHANICAL RESONANCES AND PROCESS FOR MAKING SAME

BACKGROUND OF THE INVENTION

1. Field of the Invention

The field of the invention pertains to cables used in electronic audio frequency systems. More specifically it pertains to audio cables with predictable, musically relevant, and beneficial mechanical resonances for use with microphonic or vibrationally-sensitive equipment, and process with repeatable results for making same.

2. Description of the Prior Art

The widespread use of the telegraph initiated the need for the discovery of many of the electrical parameters used in audio cable design, and the radio and the telephone supplied the impetus for the rest. And while these electrical parameters are of known significance, it will be shown that other parameters are also of significance in a musical culture where microphonic or vibrationally-sensitive equipment such as vacuum tube electronics play such a vital role.

The electronics era was ushered in with the inventions of the vacuum tube and radio. Vacuum tube driven public address systems followed shortly, and were in turn soon followed by other amplified devices such as the electric guitar. The later development of the transistor enabled electronics to become much smaller, lighter, and produce much less heat than their (vacuum) tube counterparts. The transistor also converted less vibrational energy into signal energy than the tube. These differences in size, weight, heat, and microphonics respectively almost caused the tube to disappear from use in the western world.

However, the last decade of the twentieth century saw a resurgence in the use of tube electronics. Despite these obvious technological shortcomings, a significant portion of amateur and professional recording engineers, musicians, and listeners use and prefer the sound of tube electronics.

During the transitional period between the tube and the transistor, a small number of recording engineers and record producers retained some of their tube signal processing electronics instead of trading them in on the transistorized versions that became available in the 1970's. They kept and used these tube products because they sounded more natural; the tube sound had a warmth and smoothness that wasn't available from transistorized equipment. Their work became so well regarded that others started copying their methods, and these others too became widely copied.

Because of this, the tube has made a spectacular comeback and vintage tube electronics are today expensive, high-status items found in every major recording studio. Tubes are an accepted symbiotic companion to the almost universal use of digital recording, processing, and playback equipment. The recent advent of relatively inexpensive digital signal processors and recorders has turned a specialized trend for vintage tube electronics into a general trend that also covers modern tube products, and extends down to the smallest home recording set-up.

The same comeback has occurred with a significant number of home listeners. They feel that music has a more natural and "musical" quality when vintage and some modern tube components are used in their audio systems. Similarly, many guitarists feel that their instruments sound more natural and have a greater responsiveness when used with tube amplifiers or pre-amplifiers.

Many modern tube products are available, for home and professional use, in all price ranges up to a hundred thousand dollars or more. The tube renaissance seems unstoppable. Some companies that opposed the trend several years ago have publicly changed their stance and reintroduced tube products they stopped making 25 or more years ago.

The vibration-sensitivity of a musical instrument is understood. It is well known that each and every part, from the largest to the smallest, has resonances that combine to make up that instrument's sound. This is paralleled in tube equipment because of the tube's microphonic nature. Instead of being impervious to vibrations, a tube will convert some percentage of the vibrational energy to which it is subjected into an AC voltage, which is added to the signal it is passing. It is also well known to those in the field that every tube is microphonic to one degree or another, and that they often become more microphonic as they age.

While the vibration-sensitivity of a musical instrument is taken into account during its construction, the vibration-sensitivity of a tube is usually ignored. Electronics using tubes cannot help but be as sensitive as musical instruments to the materials and techniques of construction. However, the same microphonic characteristic that causes the situation can be used for benefit.

Musical instruments have many avenues for tonal improvement after leaving the factory; musicians constantly buy products on a hunt for better and better tone. There are many aftermarket manufacturers of reeds, mouthpieces, strings, pickups, and bridges, etc., all constructed from differing materials with added embellishments, and all for the improvement of an instrument's tone. Since tube electronics are vibration-sensitive like musical instruments, they can also have their resonance signature modified after leaving the factory. Obvious ways include clamping or attaching resonators directly to the chassis of a tube product.

However, there are other, less obvious methods that allow the modification of the resonance signature of vibration-sensitive/microphonic equipment such as, but not limited to, tube products. The following example is given to illustrate the fact that while the remoteness of a set of resonances may seem at first glance to negate its ability to effect tone, these resonances are in fact a significant contributor to overall tonal quality.

It is common knowledge to those in the field that the degree of tension in a musician's arm and shoulder muscles has a significant effect on an instrument's tone. A reduction of muscle tenseness will mellow not only the musician but also the tone produced by an instrument. The resonant energy of the strings passes through the bow-hair, through the wood of the bow, and into the musician. This energy is filtered by the resonances in the bow-hair, the wood of the bow, and the combination of the mass and spring-rate of the musculature of the arms and shoulders, and coupled back into the instrument where it adds to the resulting tonality.

Some of these effects of external resonances on a musical instrument also find a parallel with tube or other microphonic or vibrationally-sensitive equipment. The flexibility of input and output cables is not a barrier to most transverse or longitudinal vibrations. In fact, connecting cables are direct paths for external vibrational energy. They are solidly and mechanically coupled to a rigid chassis that provides little or nothing to stop vibrations from being conducted directly to microphonic tube elements. The energy conducted through these cables is sufficient to significantly affect the tone of tube equipment. This situation has an analogy in the energy conducted through a bow after having interacted with the muscles of a musician.

Electrical parameters have heretofore been the primary focal point when designing audio cables. In fact, in almost all cases, with the exception of wear resistance issues, electrical parameters have been the only focal point.

There have been many examples of serious and well meaning attempts to further the art of audio cable design. A belief that conductor quality is the key to "better" sound has caused some designers to use copper of ever increasing purity and price, even though the actual reduction in resistance is vanishingly small. Other designers use exotic materials in sophisticated configurations to solve "problems" caused by the "skin effect," which has to do with the increasing resistance of conductors at very high frequencies, and frequency-dependent velocity differences in the speed of the signal. In actuality, at audio frequencies these "problems" are inaudible. These exotic cable designs can be very expensive and cost as much as one thousand dollars per foot.

Unfortunately, in many real world systems these cable designs sound different from one another. Therefore some aspect of the electrical design or the physical realization of that cable must be responsible for this. However, the electrical design parameters as given are incapable of generating sufficient audible differences at audio frequencies. This leaves the physical realization of the cable.

Because cables must have mechanical resonances, and microphonic or vibrationally-sensitive equipment will be affected by these resonances, ignoring these resonances will be detrimental to a large number of listeners, recording engineers, and musicians in their quest for better sound and tonal quality. In many situations it is the mechanical aspect of an audio cable, rather than its electrical design, that is responsible for that cable's sound.

Not only are the mechanical aspects important, but ignoring a seemingly unimportant variable in the construction of an audio cable can render its sonic outcome unpredictable, and its use for a particular musical situation unacceptable.

The prior art of audio cables has primarily been confined to concerns over electrical parameters.

Several prior art audio signal cables have emphasized frequency dependent timing issues in their design: U.S. Pat. No. 4,538,023 to Brisson discloses the use of different gauge wires of different lengths are used to increase signal integrity, and U.S. Pat. No. 4,767,890 to Magnan discloses the use of multiples of several very small gauges of wire are used in parallel to effect an all "skin" conductor.

Another example is U.S. Pat. No. 4,628,151 to Cardas discloses the use of a specific conductor size distribution is proposed for maximum efficiency of electrical signal transfer.

Another example, U.S. Pat. No, 5,929,374 to Garland discloses the reduction of dielectric absorption in the insulating medium between the conductors and to cancel vibrations set up in the conductors caused by signal passage.

Each given example of the prior art has been concerned with electrical parameters. Only one example has a portion of its design related to mechanical resonances. U.S. Pat. No. 5,929,374 includes an approach that seeks to minimize conductor-to-conductor resonances. At the same time it also introduces multiple sources of other mechanical resonances as part of this design. It's use of equal length blocks of balsa wood as insulators in a regularly spaced fashion may as claimed break up longitudinal resonances through the insulator. However, it also couples many multiples of the same series of high frequency balsa wood resonances into the conductors. The conductors then act as a conduit for this energy, coupling it directly into the equipment used with this cable.

When used with microphonic or vibrationally-sensitive electronics or transducers, the mechanical resonances from the balsa wood will in some instances be perceived as beneficial, and in others, detrimental to the sound quality. The construction of this cable will do little to keep external resonant energy from exciting the internal cable components; nor will its construction keep external energy or excited internal resonances from coupling into the equipment it is used with.

The other given examples of the prior art have claimed that their particular solutions involving a cable's electrical parameters infuse their cable designs with superior results. However, under real world conditions, no single cable design has been able to eliminate its competition. It is well known to those knowledgeable in the field that each design has its fervent supporters, its detractors, and those in between. This occurs because in any one given audio system of one type, a single cable design will often sound superior to all others. However, a fundamental problem exists because this same cable design will clearly sound inferior in another system of the same type.

Often this variability can be explained by the fact that many home and professional audio systems prefer and use tube components that are microphonic and thus vibrationally-sensitive. This makes many real world systems dependent on a favorable balance of resonances, both acoustic and mechanical. While room acoustics are reasonably well understood and sometimes taken into account, the impact of the mechanical resonances of the cable are little understood and rarely even considered.

The prior art has limitations in that each cable has its own unique and inherent "neutral" sounding cable is desirable, it will have to include sophistication in both its electrical and mechanical design components. In addition, for musical situations where a beneficial tonal character would have merit, a process for creating a cable with this specific tonality would be highly useful and beneficial.

There is no prior technology concerning audio cables having predictable, beneficial, and musically relevant mechanical resonances intended for use with microphonic or vibrationally-sensitive electronics or transducers. This is a problem previously undiscovered in the prior art and the need for such cables and a process with repeatable results to address this issue is realized by the present invention.

SUMMARY OF THE INVENTION

In view of the foregoing disadvantages inherent in the known types of audio cables now present in the prior art, the present invention provides an improved audio cable with musically relevant mechanical resonances and process for making same, and overcomes the above-mentioned disadvantages and drawbacks of the prior art. As such, the general purpose of the present invention, which will be described subsequently in greater detail, is to provide a new and improved audio cable with musically relevant mechanical resonances and process for making same and method which has all the advantages of the prior art mentioned heretofore and many novel features that result in an audio cable with musically relevant mechanical resonances and process for making same which is not anticipated, rendered obvious, suggested, or even implied by the prior art, either alone or in any combination thereof.

It is therefore an object of the present invention is to create audio cables with a musically relevant "sound" especially for use with microphonic or vibrationally-sensitive equipment. The process with repeatable results disclosed does not ignore electrical requirements, but brings into proper prominence the sonic contributions of the mechanical resonances from the cable's materials, and especially those from its construction.

A conventional audio cable is essentially homogeneous from one end to the other in between its connectors or bare ends. This can be mechanically modeled as a single spring of a given length, mass, and spring-rate (compliance). The audio cables of the present invention are created in a process that results in a mechanical model that is much more complex, and yet predictable. This new model consists of a series of many different springs with multiple lengths, masses, and compliances. This "partitioning" of a single spring into a series of multiple and different springs is the focal point of the present invention, and creates a more complex and variable resonant signature. This signature can be designed and crafted to benefit many varied musical situations.

A further object of the present invention is to provide different sounding cables for different applications. As the musical situation changes, so do the tonal requirements. A cable with a warm sound, when used in an already warm sounding system will not contribute to signal clarity when that is the tonal preference. A cable with accentuated highs and a lack of warmth will help to balance the system's warm sound, resulting in increased signal clarity. This and many other tonal styles are possible through use of the process of the present invention.

Yet another object of the present invention is to provide the ability to predict the sonic outcome of the material selection and construction process. When the results of every step in the design and construction process, no matter how small, are understood in terms of their mechanical resonances, prediction becomes possible. Without this understanding, the results are variable.

Yet still another object of the present invention is to provide the ability to repeat the sonic characteristics of a successful audio cable prototype. As with prediction, the mechanical resonances of the materials and construction process must be understood. Otherwise it becomes difficult, except in serendipitous occurrences, to duplicate successful cable sonics.

Another object of the present invention is to provide the ability to fine tune the sound of an audio cable without complete disassembly of the cable. As it obviously takes longer to completely disassemble a cable than it does to only partially disassemble it, the cost of manufacture will be decreased through methods disclosed in the present invention. Additionally, in hand-made products a certain variability will occur. The ability to fine tune the cable will increase the production yield.

A still further object of the present invention is to provide the ability for common materials to be used to build a "superior" cable. Common belief is that expensive materials are required to build a superior audio cable. However, it is a well known and confusing fact that at times expensive cables will actually make an audio system sound worse. This is the result of the prevailing focus only on electrical parameters and the cost of the materials, rather than the actual sonic results from using that cable. A results oriented approach must consider both the electrical and the mechanical.

Through use of material selection, partitioning of the length of the cable into discrete sections having beneficial mechanical resonances, and by creating other musically relevant resonances through manipulation of the necessities of construction, a superior sounding audio cable can be created using common and inexpensive materials.

Yet another object of the present invention is to create "neutral" sounding cables. Prior art audio cables are overly uniform in a mechanical sense, and develop only a few strong resonances. When used with microphonic or vibrationally-sensitive equipment, these too few resonances stand out and significantly color the sound of that equipment. A "neutral" sounding cable must have an even distribution of mechanical resonances throughout the audio spectrum. When an audio cable is built in this fashion, the contributions from the resonances are continuous and less overt; no sonic areas stand out to cause coloration of the sound. This is possible through use of the process of the present invention.

Other objects and advantages of the present invention will become apparent from the following descriptions, taken in connection with the accompanying drawings, wherein, by way of illustration and example, two embodiments of the present invention are disclosed.

Vibrational energy from a musical instrument, either from the instrument itself or from speakers powered by one or more amplifiers whose signal source is either live or recorded, excite the materials and partitions of the present invention. These resonances are directly coupled into, and add their audio frequency energy to that of the host device. This added energy is an important contributor to the tonal quality, or lack thereof, of many performances, recordings, and other musical situations.

In the case of a vibrationally-sensitive musical instrument, the mechanical resonant energy of the audio cable of the present invention is added to that of the instrument, which influences the vibrations of its strings. These string vibrations are in turn converted to electrical energy by that instrument's pick-up.

In the case of microphonic or vibrationally-sensitive passive devices such as but not limited to microphones, the externally excited resonant energy of the audio cable of the present invention is coupled into these devices and is added to its electrical output signal.

In the case of microphonic or vibrationally-sensitive active electronics such as but not limited to those using tubes, the resonant energy of the audio cables of the present invention is coupled into these electronics and added to the electrical signal passing through them.

The mechanical resonance signature of the present invention is a sum of the resonances contributed by all of its parts: the multiple partitions and their various masses and compliances, the connectors, the insulating and decorative coverings, and all other construction necessities such as informational labels.

The present invention's conductors, whether single or multiple, are selected to resonate in a chosen range of the audio spectrum. These conductors are then divided through predictable and mechanical means into multiple independently resonating sections in order to create other beneficial and musically relevant resonances. These mechanical means include compliance, mass, and hinge-point differentiation of one section from another.

The resonances created by the process and methods used in the audio cable of the present invention's construction are more important to this cable's sound than any other mechanical or electrical parameter. A process with repeatable results for constructing multiples of a successful sonic design for a specified musical situation is disclosed and is based on an in depth understanding of the mechanical ramifications of the construction process.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Figure 1:
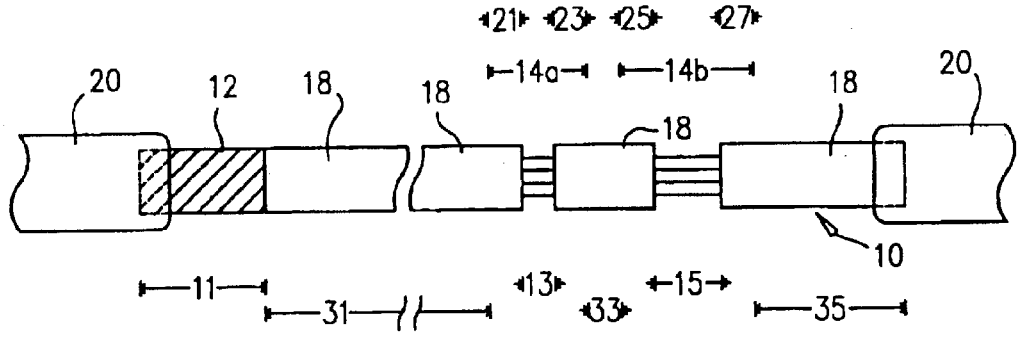
FIG. 1 is a plan view of a preferred embodiment of the invention showing compliance partitionings. (The additional insulation is omitted for sake of clarity.)

Reference numerals in drawings:

10. First preferred embodiment of the present invention
11. First compliance partition
12. Informational heat shrink label
13. Fourth compliance partition
14*a* & 14*b*. Areas covered with additional layer(s) of insulation
15. Eighth compliance partition
18. Multi-conductor cable with outer jacket
20. Connector
21. Third compliance partition
23. Fifth compliance partition
25. Seventh compliance partition
27. Ninth compliance partition
31. Second compliance partition
33. Sixth compliance partition
35. Tenth compliance partition
50. Second preferred embodiment
52. First conductor assembly
54. Second conductor assembly
61. First hinge partition
63. Second hinge partition
65. Third hinge partition
70, Conductor assembly
71. First mass partition
72. Wire binding
81. Second mass partition
82. Differing-mass conductor
83. Third mass partition
85. Fourth mass partition

DESCRIPTION OF THE PREFERRED EMBODIMENT

Descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

The figures as shown use multi-conductor cable and conductors preferable for audio frequency speaker cables. However, these techniques can be used to infuse any audio cable with predictable, relevant, and beneficial mechanical resonances for use with microphonic or vibrationally-sensitive equipment. These cables include those used for signals, speakers, and power, whether AC or DC.

Referring now to FIG. 1, a preferred embodiment 10 of an audio cable with musically relevant mechanical resonances of the present invention is shown, first compliance partition 11, heat shrink informational label 12, fourth compliance partition 13, areas covered with additional layer(s) of insulation 14*a* and 14*b*, eighth compliance partition 15, multi-conductor cable with outer jacket 18, connectors 20, third compliance partition 21, fifth compliance partition 23, seventh compliance partition 25, ninth compliance partition 27, seventh compliance partition 31, sixth compliance partition 33, and tenth compliance partition 35.

Preferred embodiment 10 of the present invention has the outer jacket removed from multi-conductor cable 18 at partitions 13 and 15, exposing the multiple individually insulated conductors. One or more layers of additional and different insulation are applied to areas 14*a* and 14*b*, in part to increase the wear resistance of the exposed conductors in partitions 13 and 15. However, the primary reason for the application of additional insulation is to create a differentiation of compliance that, in combination with length and mass, determines the frequency of resonance of partitions 13 and 15. This act creates many new transverse and longitudinal mechanical resonances because each differentiation further creates other differentiated sections, each having their own sets of resonances. These new resonances are a function of the mass, compliance, and sectional lengths of the multiple differentiated sections.

Each section of cable differentiated by a different compliance, mass, or both, from its adjacent sections is defined as a partition. The degree of differentiation is important as it is the difference of mechanical impedance from one partition to the next that causes the reflections of vibrational energy that in turn causes a partition to resonate in an individual fashion.

The act of adding one or more layers of insulating material, such as but not limited to electrical tape and/or heat shrink, to the sections 14*a* and 14*b* will also create additional partitions to each side of partitions 13 and 15. These additional partitions (21, 23, 25, and 27) have a new compliance resulting from the combination of the original outer jacket and the aforesaid additional one or more layers of insulation. While they are shown having equal length, the actual lengths required will be determined by the nature of the musical situation the audio cable of the present invention is designed to benefit.

Informational heat shrink label 12 also modifies the compliance of multi-conductor cable 18, which in turn creates compliance partition 11. The total number of compliance partitions of the preferred embodiment 10 of the present invention as shown is ten (from left to right: 11, 31, 21, 13, 23, 33, 25, 15, 27, and 35).

The mass, compliance, and length of partitions 13 and 15, as well as all those of all other partitions are selected to create relevant and beneficial resonances for the musical situation at hand through empirical means. This experience based methodology is the same as that used in the creation of musical instruments. And while an audio cable is not itself a musical instrument, its resonances will make a significant contribution to the sound of the musical instruments, or the microphonic or vibrationally-sensitive equipment the cable is used with.

Connectors 20 are not fully illustrated because they can be any connectors that have, are, or will be used for audio connections, such as but not limited to, ¼ inch phone, RCA, XLR, DIN, banana, or Speakon. Bare ends are also possible and are sometimes preferable, for example, when used with 5-way binding posts such as those often found on speakers and amplifiers. The choice of bare ends, or brand and type of connectors 20 for the audio cables of the present invention is a function of their inherent mechanical resonances, and of the musical situation at hand.

Figure 2A:
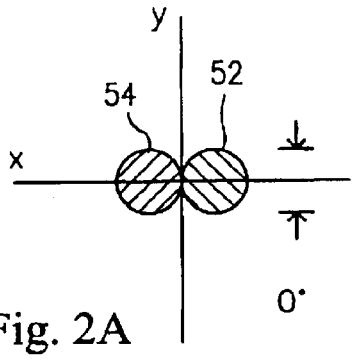
FIGS. 2*a, b, c,* and *d*, are cross section views of two twisted conductor assemblies on an x-y co-ordinate system.
Figure 2B:
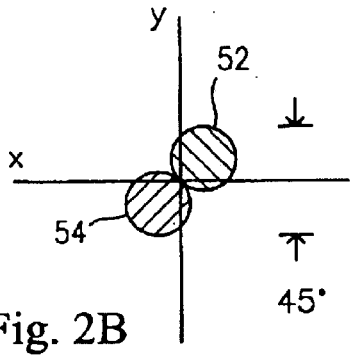
FIG. 2*e* is a plan view of another preferred embodiment of the invention showing hinge partitioning.
Figure 2C:
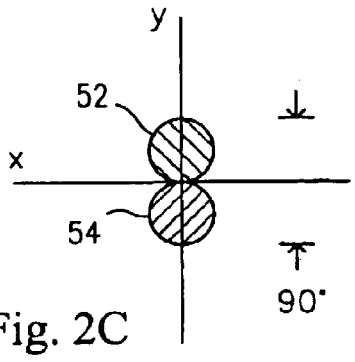
Figure 2D:
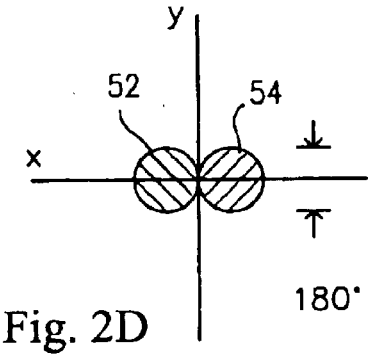

Referring now to FIGS. 2*a, b, c*, and *d*, cross section views of a twisted pair of conductor assemblies on an x-y co-ordinate system are shown, first conductor assembly 52, second conductor assembly 54, effective thickness indications, and rotational angle indications.

Twisting the two conductor assemblies 52 and 54 together causes them to cross over each other one or more times, although in some situations a partial twist may be preferable. The sections of the twisted conductor assemblies 52 and 54 having a physical orientation as shown in FIG. 2*a* will have a stiffness that is lower in the vertical plane than that in the horizontal plane. Because of this, the resonances due to vibrations in the vertical plane will be lower in frequency than those in the horizontal plane.

As the two assemblies rotate away from 0 degrees, they become stiffer as the effective thickness of the twisted cable increases. This increasing stiffness continues until 90 degrees, from whence it decreases. At 180 degrees the stiffness due to effective thickness is at the minimum; the compliance, the inverse of stiffness, is once again at the same maximum value as at 0 degrees. The cable orientations at 0 and 180 degrees are defined as the hinge points that in turn define the boundaries of this type of partition.

Figure 2E:
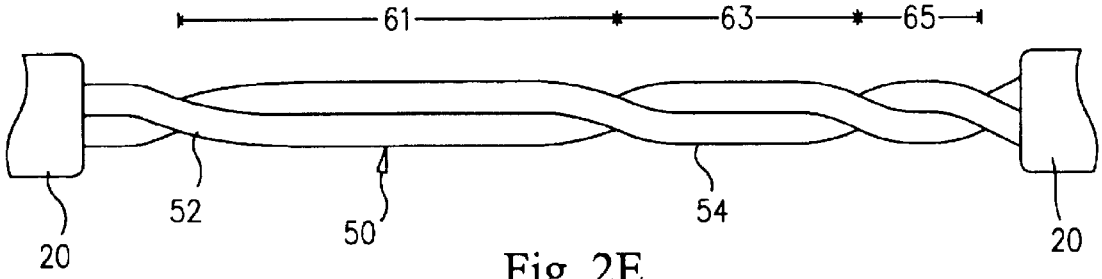

Referring now to FIG. 2*e*, a preferred embodiment 50 of an audio cable with musically relevant mechanical resonances of the present invention is shown, connectors 20, first conductor assembly 52, second conductor assembly 54, first hinge partition 61, second hinge partition 63, and third hinge partition 65.

The twisting of any two conductors or assemblies of conductors into a twisted pair cable creates discrete sections and specific mechanical resonant frequencies that are a function of the tightness of the twist. Shorter distances between cross-over points will create hinge partitions with higher resonance frequencies than will longer distances between cross-over points, all other factors being equal. These points where each conductor assembly crosses over the other are manipulated in the present invention to create hinge partitions that, when stimulated by musical vibrations, will resonate mechanically in a musically relevant and beneficial manner.

Either or both conductor assemblies 52 and 54 comprising twisted pair preferred embodiment 50 may consist of one or more similar or dissimilar conductors, of the same or dissimilar diameter. One, but not both, of conductor assemblies 52 and 54 may partially or wholly consist of un-insulated conductors if the voltages in question are sufficiently low. However, if sufficient overall insulation is individually applied to a conductor assembly, 52 and/or 54, either or both may partially or wholly consist of uninsulated conductors; the working voltages can thus also be increased. The actual choice of the one or more conductors for each of conductor assemblies 52 and 54, and any additional insulation needed, is dependent on the range of frequencies in which the particular materials in question mechanically resonate. These must be matched to the ranges of frequencies that are relevant to the musical situation the audio cable of the present invention is designed to benefit.

Figure 3A:
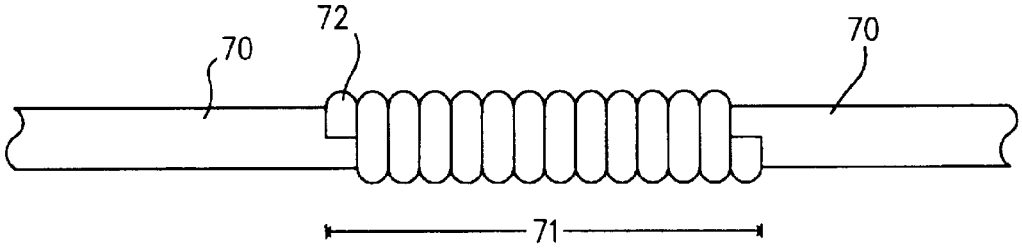
FIG. 3*a* is a plan view of a preferred embodiment of mass partitioning.

Referring now to FIG. 3*a*, a plan view of a preferred embodiment of mass partitioning is shown, third conductor assembly 70, a first mass partition 71, and wire binding 72. Third conductor assembly 70 can be a single conductor, a multi-conductor cable, a shielded cable, or represent a composite cable made from two or more other conductors such as twisted pair cables.

Wire binding 72 is wound around conductor assembly 70 and is fastened in place so that it does not change position. The fastening process itself will also create resonances, and often partitions so that the means selected must be benign, beneficial, or be compensated for in the overall design.

The extra mass of wire binding 72 will affect the fundamental resonant frequency of partition 71 in the same manner as does the wire binding of bass strings for guitar and piano. Alternatives to wire binding 72 include any other forms of mass that can be applied to conductor assembly 70 having relevant and beneficial resonances for the musical situation at hand. These forms of mass include metallic sheet stock, strips, or woven materials, and flexible tubes or containers of metallic or non-metallic materials having sufficient mass.

The positioning of wire binding 72 is usually situated to divide conductor assembly 70 or a portion of conductor assembly 70 into three partitions, of which mass partition 71 is located in the inner position, with the remaining lengths of conductor assembly 70 on either side forming the other two partitions. These three lengths are chosen to be relevant and beneficial to a musical situation.

Figure 3B:
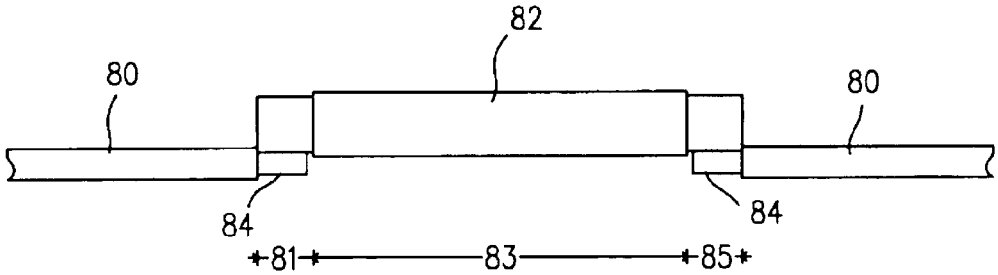
FIG. 3*b* is a plan view of a second preferred embodiment of mass partitioning.

Referring now to FIG. 3*b*, a plan view of a second preferred embodiment of mass partitioning is shown, first conductor assembly 52, second mass partition 81, differing-mass conductor 82, third mass partition 83, and fourth mass partition 85. This type of mass partitioning is used in conjunction with hinge partitioning. Second conductor assembly 54 is not shown for reasons of simplicity.

Differing-mass conductor 82 is soldered in between ends of first conductor assembly 52 to create third mass partition 83. In this case, the differing-mass conductor 82 as shown is higher in mass than is conductor assembly 52. However, whether higher in mass from lower gauge wire, or lower in mass from higher gauge wire, this differentiation in mass creates partitions.

The act of soldering creates an overlapping conductive splice between first conductor assembly 52 and differing-mass conductor 82. This splice is made up of the stripped ends of 52 and 82 that are filled or coated with solder, overlapped, and then soldered together. The extra mass of the solder and the combination of both of the masses of the stripped ends forms additional partitions with a distinctively different mass per-unit-length than the partitions on either side of the solder joint. These partitions are second mass partition 81, and fourth mass partition 85. The lengths of partitions 81 and 85 are selected to create relevant and beneficial resonances for the specified musical situation.

The length of differing-mass conductor 82, and the lengths of conductor assembly 52 on either side of it are also selected to create partitions within a hinge partition that contribute further relevant and beneficial resonances to the audio cable of the present invention. Differing-mass conductor 82 can consist of one or more conductors of one or more gauges, and include one or more non-conductors or non-conducting material.

In use, it can now be understood that an audio cable with musically relevant mechanical resonances is the same as with conventional cables. However, the results are meant to be less confusing to end users in that the sound of the cable is more predictable and beneficial when used with microphonic or vibrationally-sensitive equipment. Whereas conventional cables ignore mechanical considerations in favor of the electrical, the audio cables of the present invention take advantage of the unavoidable microphony and vibrational sensitivity of much audio equipment by having built-in relevant and beneficial mechanical resonances.

The process with repeatable results for building the audio cables of the present invention is similar to that involved when building a musical instrument. Familiarity with the musical situation for which the instrument or cable is to be used is necessary. In addition, the inherent sound of the materials of which the instrument or the cable is to be built must be familiar to the builder.

For instance, in FIG. 1 multi-conductor cable 18 will, because of its conductor size and individual and overall compliance, have a specific sound. A four-conductor fourteen-gauge cable 18 will have resonances lower in frequency because of its higher mass than will a four-conductor sixteen-gauge cable 18, everything else being equal. Partitioning will allow higher frequency mechanical resonances to be added to a fourteen-gauge cable 18, and lower resonances to a sixteen-gauge cable 18. However, it will be easier to use one or the other in any given musical situation because fewer resonances will need to be added as they already exist in the raw material.

Through proper placement, partitions are used to divide an otherwise homogeneous audio cable into a series of shorter "springs"/partitions with differing spring-rates/compliance, from one to the next. The relative lengths of the partitions in FIGS. 1, 2*e*, 3*a*, and 3*b* are established through empirical means, but follow standard rules of physics.

An audio cable's mechanical model can be restated as a mass and spring system, where the materials of the cable represent the mass, and the compliance of the cable represents the spring. In this type of system, the resonance frequency can be changed by altering the mass, compliance, or both. All other parameters remaining the same, a higher mass or compliance results in a lower frequency of resonance; a lower mass or compliance results in a higher frequency of resonance. The hinge-point partition is a variation of compliance and mass partitioning. This is because both the mass and compliance of a spring are changed if it is extended or shortened in length, keeping the per-unit-length mass and compliance unchanged.

The compliance partitions of FIG. 1 are developed by the difference in mechanical impedance and compliance from one section to the next. The maximum difference in mechanical impedance will occur when the degree of tightness of the additional layers of insulation on areas 14*a* and 14*b* is highest.

In addition to its use for altering the compliance and thus the resonances of a section of cable, the insulation itself will contribute resonances of its own. Different types and brands of insulating materials, whether applied by hand and/or machine, each have their own characteristic degree of compliance that in part determines its resonant frequency. Insulator types and brands can thus be selected to place their inherent and unavoidable resonances into musically relevant frequency ranges.

Furthermore, as different colors are the result of the inclusion of different pigments into insulating materials such as electrical tape and heat shrink, this change in chemical composition alters the materials' compliance. Different color insulators will then each resonate differently, usually in different areas of the treble frequency range. Thus the use of one or more specifically colored insulations to add relevant and beneficial resonances aids in the process of creating superior audio cables for specified musical events.

The small partitions of FIG. 1, partitions 13, 15, 21, 23, 25, 27 and 33, are selected to create relevant higher frequency resonances, and the longer partitions they create, partitions 31 and 35, are selected to create relevant middle and lower frequency resonances.

An additional method for changing the resonant frequency of a standard mass and spring system is to change the spring's length, keeping the per-unit-length mass and compliance unchanged. As the length of any resonating member is lengthened, its resonance goes down in frequency; a shorter member will resonate higher in frequency. This method is used in all of the figures. In FIG. 1, while a change in compliance is used to differentiate one partition from another, it is the length of each partition that determines its resulting resonant frequency. In FIG. 2*e*, it is the length between the hinge-points that determines the resulting resonant frequency.

FIG. 3*a* showers a method of changing the mass of conductor 70, creating partition 71.

FIG. 3*b* shows a method of changing the mass of a partition differentiated through hinge points. Only conductor assembly 52 is shown; second conductor assembly 54 is not shown for reasons of clarity.

Mass partitioning methods also change the compliance. Bound or heavier gauge wire is usually more stiff, less compliant than an unbound or lighter gauge wire; lighter gauge wire is usually less stiff, more compliant.

The use of a higher mass conductor 82 has the potential to lower the resonant frequency of its hinge partition. However, its lower compliance has also the potential to raise it simultaneously. Because of this, a degree of over compensation is necessary to effect a given amount of lowering of resonant frequency through mass partitioning with a higher mass conductor 82. This is accomplished by choosing partitions of sufficient length to compensate for the accompanying lower compliance of a higher mass conductor 82, or by lengthening this partition when possible.

The use of a lower mass conductor 82 will lower the resonant frequency of its hinge partition when the lower-mass/lighter-gauge wire is less stiff.

The choice of a higher or lower mass differing-mass conductor 82 is determined experimentally. Both create secondary partitions apart from their hinge partitions. At low frequencies, a higher mass conductor 82 will lower the resonance of composite partition which will extend one or more partitions on either side of conductor 82. A lower mass conductor 82 will create a secondary hinge point, and create two low frequency partitions, one on either side of a lower mass conductor 82.

In order to develop the sound of an audio cable of the present invention for a particular musical situation, one first selects materials including conductors having appropriate electrical and mechanical parameters. A cable is then constructed from an initial design; one or more types and lengths of partitions arc used to create relevant resonances. The cable is then listened to in the relevant musical setting.

Adjustments to the design are made with the following methods:

1. The use of short partitions (approximately less than ½ inch, depending on the material), lighter gauge wire (20 gauge and higher), increasing the compliance of a partition by covering it with additional layers of insulation, and use of materials with a mass or compliance conducive to high frequency resonances (from 1.28 kHz to 20 kHz) are methods used to increase the amount of high frequency resonances in the process of building the audio cable of the present invention.

If the added resonances are too high in frequency, partitions of longer length or having higher mass or compliance should be substituted until the resonances fall in the desired area. If the added resonances are too low in frequency, partitions of shorter length or having lower mass or compliance should be substituted.

2. The use of mid-length partitions (from approximately ½ inch to 6 inches, depending on the material), intermediate gauge wire (from 16 gauge to 20 gauge), and use of materials with a mass or compliance conducive to middle frequency resonances (from 160 Hz to 1.28 kHz) are methods used to increase the amount of midrange energy in the process of building the audio cable of the present invention. The intermediate gauge wire can be used as either a conductor or as the binding on another conductor partition whose resonance it is desired to change.

If the added resonances are too high in frequency, partitions of longer length or having higher mass or compliance should be substituted until the resonances fall in the desired area. If the added resonances are too low in frequency, partitions of shorter length or having lower mass or compliance should be substituted.

3. The use of longer-length partitions (from 6 inches to 4 feet or longer, depending on the material), heavier gauge wire (14 gauge and lower), and use of materials with a mass or compliance conducive to low frequency resonances (from 20 Hz to 160 Hz) are methods used to increase the amount of low frequency resonances in the process of building the audio cable of the present invention.

If the added resonances arc too high in frequency, partitions of longer length or having higher mass or compliance should be substituted until the resonances fall in the desired area. If the added resonances are too low in frequency, partitions of shorter length or having lower mass or compliance should be substituted.

4. When it is desired to alter the resonant qualities of an already constructed cable, re-partitioning of a cable with twisted conductor assemblies can be performed without disassembly of the cable. This is done to alter the midrange and bass resonances, and is accomplished by sliding one conductor along the other.

A change in high frequency resonances can easily be accomplished through substitution of insulation color or type of insulation. For instance, a substitution of white Teflon tape for any color electrical tape will subtly but significantly change the audible high frequency characteristics of an audio cable. As the Teflon tape is much thinner than electrical tape, its resonances will occur at higher frequencies.

When it is desired to alter the resonant qualities of a jacketed cable, the proportion of partitions in the preferred frequency range should be increased.

More low frequency energy will result from eliminating one or more mid-to-high frequency partitions. In the case where a portion of the outer jacket insulation was removed, electrical tape of the same color can be loosely wound about the removed section in a fashion to minimize the mechanical impedance differential. This will minimize the reflection of energy and creation of higher frequency resonance, and allow lower frequency resonances to develop, as desired.

These changes can usually be affected by removal of the connector at only one end, simplifying and shortening the time needed for modification.

Once changes to the resonance design are finalized, the cable prototype should be kept as a sonic reference. All measurements of partition size and placement should be made accurately, as errors can quickly add up and defeat the goal of repeatable results. Colors of materials, including clear, black, and metallic, are equally as important as measurements because entirely different sonics will result even if all partitions remain constant. It should be kept clearly in mind that the color of a material and the compliance of that material are directly related.

It should also be kept clearly in mind that material "equivalents" from different manufacturers do not exist. Two similar products from two different manufacturers will not have or contribute to the same resonant frequencies, as the materials will not exactly match. Therefore, the repeatability of any design will depend on a prohibition of substitutions. If a material substitution is made, the design will have to be modified or the goal of repeatable results will not be met.

Traditionally, musicians who do not like the tone quality of their sound are faced with the necessity of buying new equipment or having it modified. Modification often involves having new parts installed by a competent technician, with the accompanying down-time. If the modification is not to the owner's taste, this endeavor becomes even more expensive in both time and money, as re-modification is required. The alternative, the selling and buying of equipment in order to make improvements, is also very time consuming and generally no less expensive.

Through use of audio cables with musically relevant and beneficial resonances, a considerable savings in both time and money can be made. As a mere change in cables will accomplish a change in tonality equal to or better than most modifications, trips to a technician for such modifications and the accompanying down-time will be eliminated.

It will also be much less expensive to have equipment suited to more than one type of music. Many musicians have multiple instruments and amplifiers in order to play different styles of music. This becomes very expensive in initial cost and subsequent maintenance, requires considerable storage, and also requires extra effort in moving equipment to and from a job. With audio cables designed for the differing tonal styles needed for the various styles, a musician would need only one basic system and achieve a significant savings in money, space, and portability. No such cables are available at present.

Listeners, musicians, and recording engineers requiring neutral cables for their microphonic or vibrationally-sensitive equipment will benefit from audio cables made with both electrical and mechanical parameters properly considered. As with differing tonality cables, neutral cables are not available at present.

Furthermore, the present invention of the audio cables and process has the additional advantages in that it provides the ability to predict the sound of the cable because careful consideration has been made of all of the mechanical resonances that occur during the process of building the cable;

it provides the ability to repeat the sonic characteristics of successful cable prototypes;

it allows the sonics of the cable to be fine tuned without complete disassembly of the cable; and it allows the use of common materials to make superior sounding cables.

The need for audio cables that can be tonally matched to different specified musical situations is clear, and will be realized by the present invention.

Although the description above contains many specificities, these should not be construed as limiting the scope of the invention but as merely providing illustrations of some of the presently preferred embodiments of this invention. For example, the connectors can be those not normally associated with audio, such as circular multi-pin connectors used with video, power supplies, and by the military; the cable can be multi-function and carry multiple types of signals and/or power; the cable could be used internal to one or more pieces of equipment, etc.

What is claimed is:

1. An audio cable for producing predictable, musically relevant, and beneficial mechanical resonances for audio equipment comprising, in combination:

a multi-conductor cable having at least two conductor assemblies in a twisted configuration;

a pair of connectors located at each end of said multi-conductor cable;

a first hinge partition for altering the mechanical resonance of said audio cable, said first hinge partition having a length and an angle of rotation;

at least one additional hinge partition for altering the mechanical resonance of said audio cable, said additional hinge partition having a length and an angle of rotation not equal to said length and angle of rotation of said first hinge partition;

wherein said first hinge partition is the first twisted section of said twisted conductor assemblies of said multi-conductor cable, said first hinge partition being adjacent to the first cross-over point of said twisted conductor assemblies;

wherein said additional hinge partition is the subsequent twisted section to said first twisted section of said twisted conductor assemblies of said multi-conductor cable, said additional hinge partition being adjacent to the second cross-over point of said twisted conductor assemblies which is adjacent to said first hinge partition; and wherein said length and angle of rotation of said first hinge partition and said additional hinge partition being independently adjustable to create said mechanical resonance in said audio cable so as to produce a predetermined tonal sound from an audio equipment connected thereto.

2. The audio cable of claim 1, wherein said conductor assemblies of said first hinge partition are twisted one hundred eighty degrees (180°).

3. The audio cable of claim 1, wherein said conductor assemblies of said additional hinge partition are twisted one hundred eight degrees (180°) from said conductor assemblies of said first hinge partition.

4. The audio cable of claim 1, wherein said conductor assemblies are of different thickness.

5. The audio cable of claim 1, wherein said conductor assemblies are of equal thickness.

6. The audio cable of claim 1, wherein said conductor assemblies have a thickness corresponding to a predetermined mechanical resonance frequency created by said conductor assemblies for producing said predetermined tonal sound.

7. The audio cable of claim 1, wherein at lest one of said conductor assemblies is un-insulated.

8. The audio cable of claim 1, wherein at least on of said conductor assemblies is partially insulated.

9. The audio cable of claim 8, wherein said multi-conductor cable is four feet in length and having four conductor assemblies of sixteen gauge insulated wire, said multi-conductor cable having a fluorescent red polyester woven sheathing over said multi-conductor cable, a layer of blue electrical tape wound around said fluorescent red polyester woven sheathing and being located at one end of said multi-conductor cable over, and a black heat shrink label over said blue electrical tape, wherein said pair of connectors are one fourth inch (¼") phone plug connectors including a layer of white Teflon tape tightly wound around said connector's solder connections, and further comprising a white outer jacket having three removed sections and two layers of red electrical tape tightly wound around said removed sections.

10. The audio cable of claim 9, wherein said audio cable is used to connect an amplifier to a speaker.

11. The audio cable of claim 8, wherein one of said conductor assemblies of said multi-conductor cable is a ten gauge insulated wire and the other said conductor assemblies of said multi-conductor cable are a twisted quad of two twenty gauge wires and two eighteen gauge wires, wherein said multi-conductor cable being covered by a grey polyester woven sheathing, a layer of blue and red electrical tape wound around said grey polyester woven sheathing and being located at on end of said multi-conductor cable, and a red heat shrink label over said layer of blue and red electrical tape, and wherein said pair of connectors are one fourth inch (¼") phone plug connectors including a layer of white Teflon tape tightly wound around said connector's solder connections.

12. The audio cable of claim 11, wherein said audio cable is used to connect an amplifier to a speaker, said audio cable being adapted to produce said predetermine tonal sound with clear and prominent rounded bell-like highs, and wherein said first hinge partition and said additional hinge partitions are adapted to produce a sound having an even midrange and bass.

13. The audio cable of claim 8, and further comprising at least one mass partition located between said connectors and fastened to the exterior of said conductor assemblies of said multi-conductor cable.

14. The audio cable of claim 13, wherein said mass partition is a wire binding wound around the un-insulated section of said partially insulated conductor assembly of said multi-conductor cable.

15. The audio cable of claim 1 and further comprising at least one mass partition located between said connectors and fastened to the exterior of said multi-conductor cable.

16. The audio cable of claim 15, wherein said mass partition is a wire binding wound around said multi-conductor cable.

17. The audio cable of claim 1, wherein at least one of said conductor assemblies of said multi-conductor cable having a section removed therefrom thereby producing a pair of free ends in said conductor assembly, and further comprising at least one mass partition fastened to the free ends of said conductor assembly connecting said free ends of said conductor assembly, wherein said mass partition having a different mass than said conductor assembly fastened thereto.

18. A process of making an audio cable having a predetermined mechanical resonance, wherein said audio cable having a multi-conductor cable including at least two twisted conductor assemblies, a pair of connectors including Teflon tape wound around said connector's connections, a first hinge partition being the first twisted section of said twisted conductor assemblies, at least one additional hinge partition being the subsequent twisted section adjacent said fist twisted section, a mass partition fastened to said conductor assemblies, a sheathing over said multi-conductor cable, at least one layer of tape wound around a portion of said sheathing, and a heat shrink label attached over said layer of tape, comprising the steps of:

selecting a predetermined tonal sound producible by an audio equipment which is connected to a second audio equipment by said audio cable, wherein said predetermined mechanical resonance of said audio cable assists in the production of said predetermined tonal sound;

determining the number of said additional hinge partitions needed to produce a predetermined mechanical resonance from said additional hinge partitions;

twisting said multi-conductor cable until the number of hinge partitions equal said first hinge partition plus the determined number of said additional hinge partitions is produced;

adjusting the length of said first hinge partition of said audio cable until a predetermined mechanical resonance is produced from said first hinge partition;

adjusting the individual lengths of each said additional hinge partitions of said audio cable until said predetermined mechanical resonance is produced from said additional hinge partitions;

covering said multi-conductor cable with said sheathing, said sheathing having a predetermined mechanical resonance;

adjusting the number of said tape layers wrapped around said portion of said sheathing until a predetermined mechanical resonance is produced from said tape layers;

adjusting the size of said heat shrink label that is attached over said tape layers until a predetermined mechanical resonance is produced from said heat shrink label; and wherein the combination of said predetermined mechanical resonance of said first hinge partition, said predetermined mechanical resonance of said additional hinge partitions, said predetermined mechanical resonance of said sheathing, said predetermined mechanical resonance of said layers of tape, and said predetermined mechanical resonance of said heat shrink label is equal to said predetermined mechanical resonance of said audio cable.

* * * * *